US008430403B1

(12) United States Patent
Wright

(10) Patent No.: US 8,430,403 B1
(45) Date of Patent: Apr. 30, 2013

(54) GAMING TOKEN

(76) Inventor: Timothy A. Wright, Newark, OH (US)

( * ) Notice: Subject to any disclaimer, the term of this patent is extended or adjusted under 35 U.S.C. 154(b) by 36 days.

(21) Appl. No.: 13/279,854

(22) Filed: Oct. 24, 2011

(51) Int. Cl.
*A63F 9/24* (2006.01)
*G06K 19/06* (2006.01)

(52) U.S. Cl.
USPC ..... 273/148 R; 273/288; 40/27.5; D21/390; 264/279.1; 463/47

(58) Field of Classification Search ..... 273/148 R, 273/288; 40/27.5; D21/390; 264/279.1; 463/47
See application file for complete search history.

(56) References Cited

U.S. PATENT DOCUMENTS 1,475,652 A 11/1923 Polizzi
5,166,502 A * 11/1992 Rendleman et al. ..... 235/492
5,498,859 A * 3/1996 Farmont ..... 235/384
5,676,376 A * 10/1997 Valley ..... 273/288
5,735,742 A * 4/1998 French ..... 463/25
5,895,321 A * 4/1999 Gassies et al. ..... 463/29
6,508,466 B1 1/2003 Rendleman
6,973,747 B2 * 12/2005 Ratmansky et al. ..... 40/327
7,182,901 B2 2/2007 Tseng et al.
7,913,915 B2 * 3/2011 Castaneda ..... 235/492
7,918,455 B2 * 4/2011 Chapet et al. ..... 273/148 R
2002/0006829 A1 * 1/2002 Purton ..... 463/47
2003/0177674 A1 9/2003 Miller
2005/0059479 A1 3/2005 Soltys et al.
2006/0279420 A1 * 12/2006 Charlier et al. ..... 340/539.1
2008/0092419 A1 4/2008 Muramoto
2010/0006654 A1 * 1/2010 Poel ..... 235/492
2010/0105486 A1 * 4/2010 Shigeta ..... 463/47

* cited by examiner

*Primary Examiner* — Benjamin Layno
(74) *Attorney, Agent, or Firm* — Howard M. Cohn

(57) ABSTRACT

A chip member and method of constructing a chip member including an outer portion surrounding an inner portion. The outer portion has a first outer side. The inner portion forms a first cavity opening to the first outer side. The first outer side has a first lip overlying the first cavity. A first flexible tab is secured within the first cavity by the first lip.

14 Claims, 4 Drawing Sheets

GAMING TOKEN

TECHNICAL FIELD OF THE INVENTION

The present invention relates to gaming tokens or tokens and the method for making these tokens. More specifically, the invention is directed to a relatively simple and inexpensive gaming token that can be easily customized to immediately insert a captured image, and a method for making such a token.

BACKGROUND OF THE INVENTION

Gaming tokens or tokens of various denominational values are commonly used in games of chance. These tokens are used by patrons to wager a desired amount of money in such a game, and can later be exchanged for currency. In certain circumstances, it may be desirable to customize a gaming token by incorporating a custom image on site where the token is being used. Adding an image on site has been prohibited because of the complicated process needed to manufacture the token.

SUMMARY OF THE INVENTION

According to an embodiment of the present invention, a gaming token is constructed of a chip member comprising an outer portion surrounding an inner portion. The outer portion has a first outer side. The inner portion forms a first cavity opening to the first outer side. The first outer side has a first lip overlying the first cavity. A first flexible tab is secured within the first cavity by the first lip.

According to another embodiment of the present invention, a method of constructing a gaming token is disclosed. The method includes providing a chip member having an outer portion surrounding an inner portion wherein the outer portion has a first outer side and the inner portion forms a first cavity opening to the first outer side. The first outer side is provided with a first lip overlying the first cavity. A first flexible tab is secured within the first cavity by the first lip.

DETAILED DESCRIPTION OF THE PREFERRED EMBODIMENTS

Figure 1:
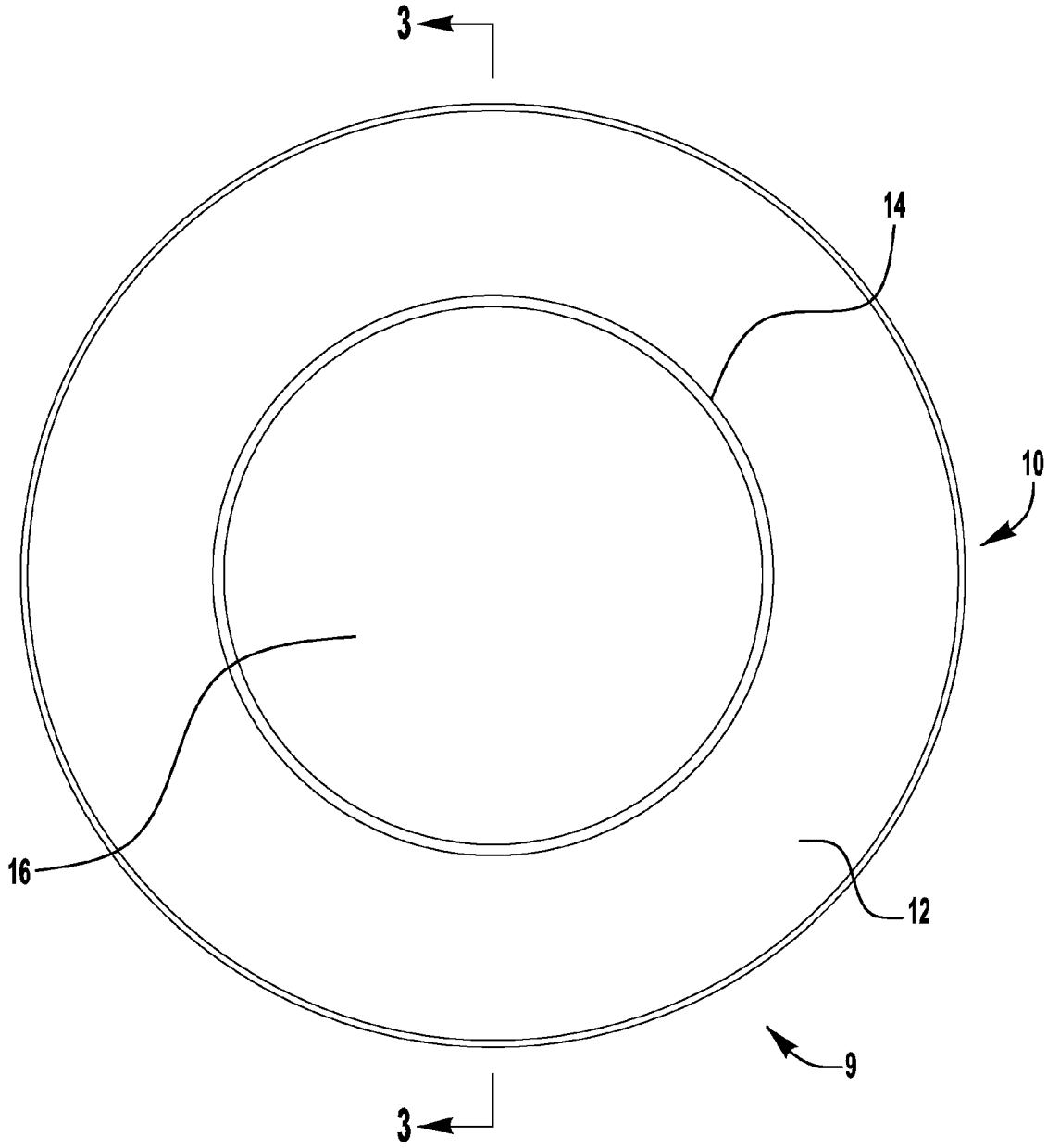
FIG. 1 is a top view of a gaming token, in accordance with the present invention.

FIG. 1 illustrates a gaming token 9 with a chip member 10, having an outer portion 12 which surrounds an inner portion 14. An flexible insertable tab 16 is secured within the inner portion 14. The flexible tab 16 can be formed of a material, such as photographic material onto which an image has been fixed thereon, or of a material with a coated surface onto which an image has been affixed.

Figure 3:
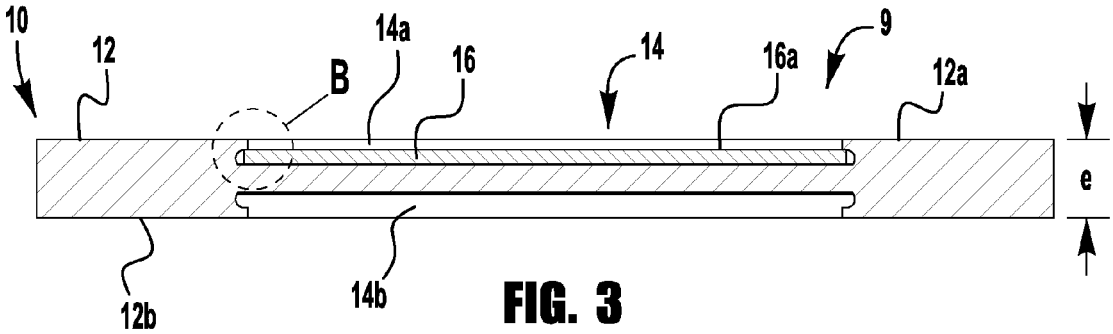
FIG. 3 is a cross-sectional view through 2-2 of FIG. 1, in accordance with the present invention.

As shown in FIG. 3, the gaming token 10 is constructed of two portions, an outer portion 12 and an inner portion 14. The outer portion 12 has a generally circular perimeter edge, a first outer side 12*a* and a second outer side 12*b*. The inner portion 14 includes a first circular cavity 14*a* opening to the first outer side 12*a* and is encompassed thereby. The inner portion 14 can also include a second circular cavity 14*b* opening to the second outer side 12*b* and is encompassed thereby. The second circular cavity 14*b* has the same construction as the circular cavity 14*a*.

Figure 4:
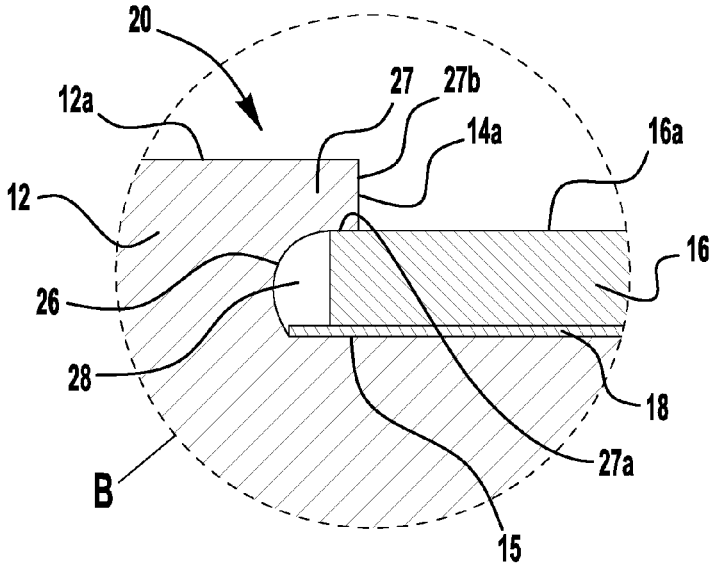
FIG. 4 is a blowup of section B of FIG. 2, in accordance with the present invention.

As shown in FIG. 3, the first circular cavity 14*a* is constructed to retain the flexible tab 16 so that an upper surface 16*a*, having an image affixed thereon, is facing outward from the second outer side 12*b* of the token 9. When the tab 16 is inserted and secured within circular cavity 14*a*, the upper surface 16*a* of the tab 16 is slightly below the level of the first outer side 12*a*, as seen in FIG. 4. The inner surface 15 of circular cavity 14*a* may be covered by a strip of contact material 18 comprised of different material than the main body of the chip member 10. The material of the contact surface 18 may be chosen specifically for such properties as compressibility and traction. Additionally, the contact surface 18 may be adhesive.

Referring again to FIG. 3, token 9 is designed to hold or retain a captured image on the upper surface 16*a* of photographic material of tab 16 and instantly create a unique and finite in quantity token. The ability to customize gaming token 9 distinguishes itself from tokens which are preformed and do not allow for a person to instantly create a specific use of the token. In addition the tab 16 can be constructed of plastic resin, vinyl, or a similar material on which an image is mounted.

The outer portion 12 and inner portion 14 of token 9 can be made of man-made materials or of any natural occurring earthen material and metals, or in any combination there of. While the token 9 and the inner portion 14 are described as being circular, they can be of any size and shape, such as square or rectangular. In a preferred embodiment, the token 9 is circular, with a diameter "d" of between 1.5 inches and 3 inches, a thickness "e" of approximately ⅛ inch.

A marginal section 20 at the interface of the outer portion 12 and the inner portion 14 is illustrated in detail in FIG. 4. The construction of the marginal section 20 provides the token 9 with its unique ability to receive and mount the flexible tab 16 of photographic material with an image on surface 16*a* in the circular cavity 14*a* of the inner central portion 14. The marginal section 20 comprises an undercut groove 26, shown with a concave surface. A lip 27, extending from the outer portion 12, protrudes over the groove 26 and creates a pocket 28 in the space between the underside 27*a* of lip 27 and the surface 15 of inner portion 14. The lip 27 may be made of the same material as the outer portion 12 and may be continuous with it, or it may be made of a different material and fixed to the outer ring portion by any means. As seen in FIG. 4, the pocket 28 is bounded by the underside 27*a* of the lip 27, the surface 15 of inner portion 14, and the inner concave surface of the undercut groove 26. Ideally the vertical thickness of pocket 28, between the underside 27*a* of the lip 27 and the surface 15 of inner portion 14 will correspond approximately to the thickness of the tab 16 of photographic material. Notably, the outer diameter of the concave surface of cylindrical groove 26 is slightly greater than the diameter of the inward circular surface 27*b* of the lip 27.

Figure 2:
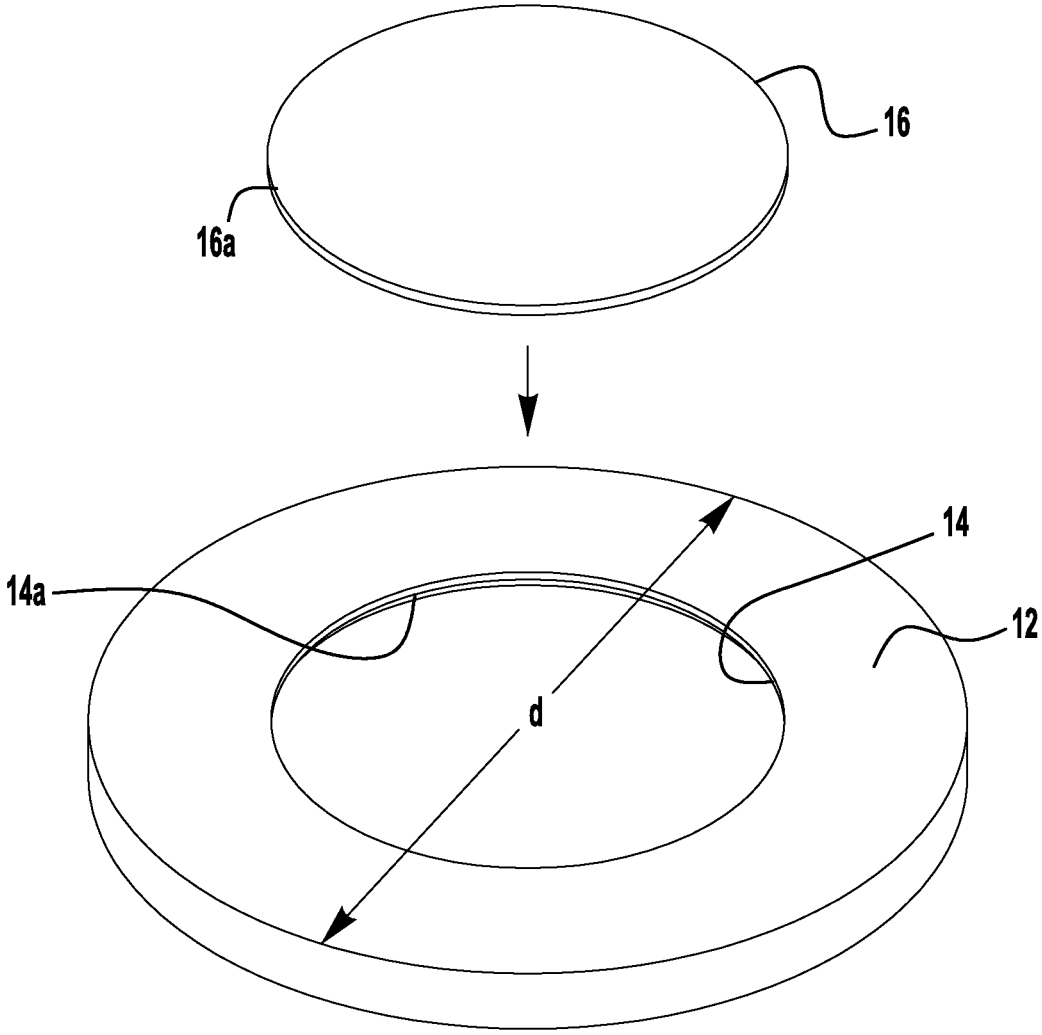
FIG. 2 is a three dimensional front, exploded view of a gaming token and an insert to be attached to the poker token, in accordance with the present invention.

In order to mount the tab 16 of photographic material within the within circular cavity 14*a* onto the surface 15 or onto the contact surface 18, the process as illustrated in FIGS. 2-4 can be undertaken.

The flexible tab 16 of photographic material with an image on surface 16*a* can be cut to a desired shape and size. In order to successfully mount the tab 16 to the token 9, the material forming tab 16 with the captured image can be cut to a size intermediate between the inner surface of the groove 26 and the circular surface 27*b* of lip 27.

The photographic material with the captured image can be cut either by hand or by mechanical means. After it is cut to the appropriate size, e.g., to form tab 16, the tab is pressed across the surface 27*b* of cavity 14*a* into the inner central portion 14. The pressing action will cause the edges of the tab 16 to tuck into the pocket 28, and remain held in place by the lip 27. Additionally, the adhesive coating of contact surface 18 may also insure that the tab 16 is held in place.

Figure 5:
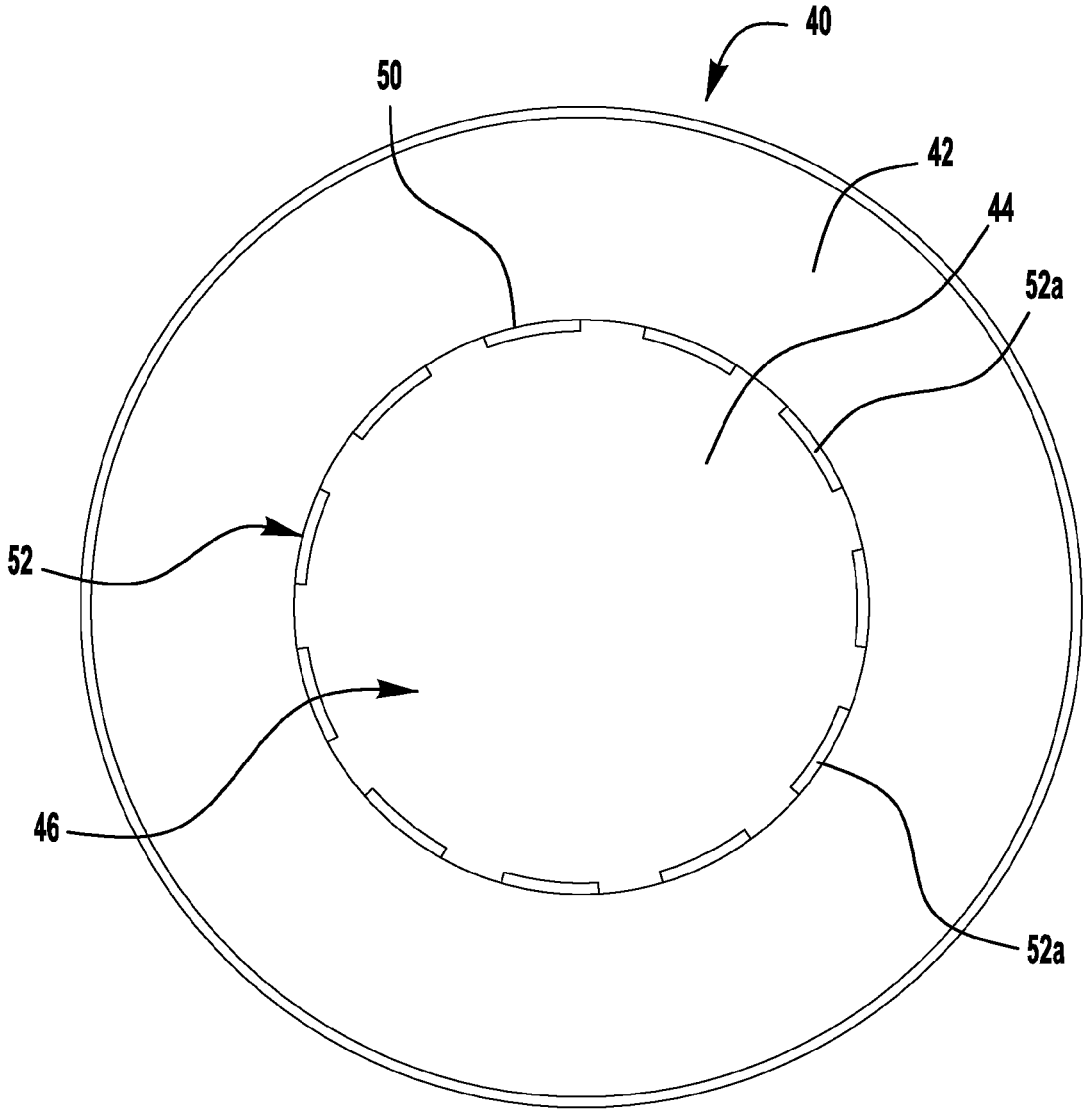
FIG. 5 is a top view of an alternative embodiment of a gaming token, in accordance with the present invention.

An alternative embodiment of a gaming token 40 is illustrated in FIG. 5. The gaming token 40 has an outer portion 42 (compare outer portion 12) which surrounds an inner portion 44 (compare outer portion 14) having a cavity (compare cavity 14a) into which a flexible tab 46 (compare tab 16) is secured. The tab 46 can be formed of a material, such as photographic material, onto which an image has been fixed thereon, or of a material with a coated surface, or a printable surface, onto which an image has been affixed.

In this embodiment, as shown in FIG. 5, a marginal section 50 at the interface of the outer portion 42 and the inner portion 44 enables the tab 46 to be secured within the cavity of the inner portion 44. As with the embodiment shown in FIGS. 1-4, the marginal section 50 comprises a lip 52 formed with an undercut groove (compare 26) having a concave surface. The lip 52, extending from the outer portion 42 and over the inner portion 44 forms a discontinuous surface, between the outer portion 42 and the inner portion 44. The lip 52 is broken into a plurality of spaced projections 52*a*. By forming the lip 52 of a plurality of spaced projections 52*a*, the token 46 can be more easily pressed into the cavity of the inner portion 44.

Figure 6:
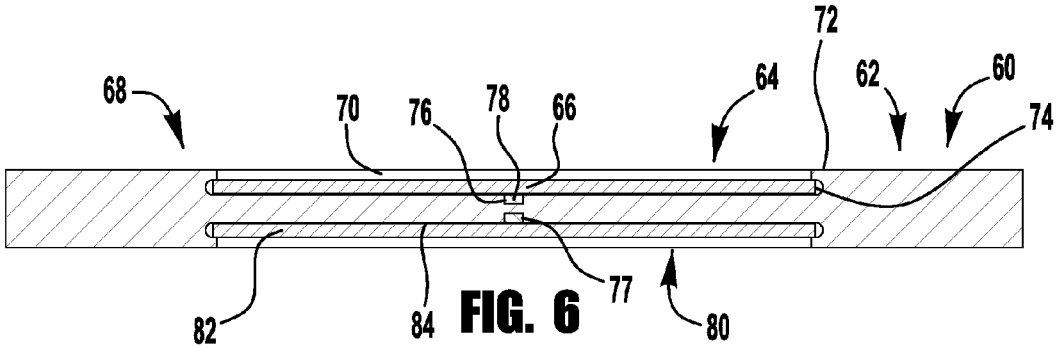
FIG. 6 is a cross-sectional view of an alternative embodiment of a gaming token, in accordance with the present invention.

As seen in FIG. 6, a further alternative embodiment of the present invention is illustrated. In this embodiment, the token 60 (compare token 9) consists essentially of three portions, an outer portion 62, a central portion 64 encompassed by the outer portion and a gaming tab 66 (compare 16) may be mounted. The flexible tab 66, as with tabs 16 and 46 can be formed of a material, such as photographic material, onto which an image has been fixed thereon, or of a material with a coated surface onto which an image has been affixed.

In this embodiment, as shown in FIG. 6, a marginal section 68 at the interface of the outer portion 62 and the inner portion 64 enables the tab 66 to be secured within a cavity 70 formed in the inner portion 64. As with the embodiment shown in FIGS. 1-4, the marginal section 68 forms the cavity 70 of lip 72 formed with an undercut groove 74 with a concave surface. The lip 72, extending from the outer portion 62 and over the inner portion 64 forms the cavity 70, between the outer portion 62 and the inner portion 64, into which the tab 66 is secured.

As further shown in FIG. 6, a recessed section 76 is disposed below cavity 70 of the inner portion 64. The recessed section 76 can be circular or of any desired shape and does not extend to the undercut groove 74. The depth of the recessed section 76 corresponds to the thickness of an RFID device 78, which includes a microchip and an antennae attached thereto. The antennae portion (not shown) of the RFID device 78 underlies the tab 66. Recessed section 76 and recessed section 77 (see below), can be used as locators for chucking up the token 60 during manufacturing the groove 28.

The RFID device 78 is placed in the recessed section 76 prior to mounting the tab 66 into the cavity 70 of the inner portion 64. Once the tab 66 is secured in cavity 70, the RFID device 78 will also be secured in place. The RFID device 78 is undetectable by sight or touch, as the microchip sits below the flush mounting surface of the tab 66. RFID device 78 is includes a microchip and an antennae portion that uses radio waves to transfer data from the token 60, to a reader for the purpose of identifying and tracking the object. Some RFID devices can be read from several meters away and beyond the line of sight of the reader. The material composition of the token 9 can be selected to allow for a non-interference read range of variable distances for the RFID device 78.

In the present invention, the RFID device 78 may be used to prevent counterfeiting of the token 60, or for expediently determining the value of the token with a reader (not shown). RFID device 78 can be secured within recessed section 76 with an adhesive, or other appropriate method.

The material used to form the inner and outer sections 64,62 of the token 60 can be selected from man-made materials or of any natural occurring earthen material and metals, or in any combination thereof which allow the RFID device 78 to be at varying distances and from either side of the chip 60.

It is also within the terms of the embodiment shown in FIG. 6 to provide a central portion 80 on the underside of chip 60 which is a substantially mirror copy of cavity 70 with a recessed section 84 into which a second tab 82 is mounted and a recessed section 77 into which the microchip of an RFID is mounted.

Token 60 is designed to protect against potentially tampering with the RFID devices 78,84. Should the mounted tabs 66,82 be removed to tamper with the RFID devices 78,84 there-under, the lip 72 will be broken or fractured, and it will be immediately evident that the integrity of the token 60 has been compromised.

The image captured and produced on/in the token can be: a person or group of people; a natural occurring scene, both near and afar; man-made objects; all creatures, big and small of the earth: past, present, and future; or those imagined by man's mind or created by machine.

The image captured and produced on/in the token can be a letter, word, or group of words; numbers; alpha-numeric representations, symbols and logos. This is to include any and all known and unknown written languages and symbols.

A large quantity of the tokens or poker chips of value including an RFID token can be mass produced. While the token 9 is typically used as a poker chip or token, it can also be used as a picture frame with the image on the tab 16.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A gaming token, comprising;

a chip member comprising an outer portion surrounding an inner portion;

the outer portion having a first outer side and the inner portion forming a first cavity opening to the first outer side;

the first outer side having a first lip overlying the first cavity;

a first flexible tab secured within the first cavity by the first lip;

the first cavity having an inner surface to support the flexible tab and spaced from the first lip such that the first tab is secured between the inner surface and the first lip, the inner surface of the first cavity being covered by a strip of contact material; and wherein the first cavity has an inner surface to support the first flexible tab and a first recessed section surrounded by and below the inner surface.

2. The gaming token of claim 1 further including an RHD chip within the first recessed section.

3. The gaming token of claim 1, wherein the flexible tab is constructed of photographic material with an upper surface having an image affixed thereon.

4. The gaming token of claim 1, wherein the flexible tab is secured below the first outer side.

5. The gaming token of claim 1, wherein the first cavity is circular and first tab is circular.

6. A gaming token, comprising;

a chip member comprising an outer portion surrounding an inner portion;

the outer portion having a first outer side and the inner portion forming a first cavity opening to the first outer side;

the first outer side having a first lip overlying the first cavity;

a first flexible tab secured within the first cavity by the first lip, the outer portion having a second outer side and the inner portion forming a second cavity opening to the second outer side;

the second outer side having a second lip overlying the second cavity;

a second flexible tab secured within the second cavity by the second lip; and wherein the second cavity has an inner surface to support the second flexible tab and a second recessed section surrounded by and below the inner surface.

7. The gaming token of claim 6 further including a second RFID chip within the second recessed section.

8. The gaming token of claim 6, wherein the second flexible tab is constructed of photographic material with an upper surface having an image affixed thereon.

9. The method of constructing a gaming token, comprising;

providing a chip member having an outer portion surrounding an inner portion wherein the outer portion has a first outer side and the inner portion forms a first cavity opening to the first outer side;

providing the first outer side with a first lip overlying the first cavity;

securing a first flexible tab within the first cavity by the first lip;

providing the first cavity with an inner surface spaced from the first lip;

securing the first tab between the inner surface and the first lip;

providing the first cavity with an inner surface supporting the first flexible tab;

surrounding a first recessed section by and below the inner surface; and including an RFID chip within the first recessed section.

10. The method of claim 9, including the step of constructing the flexible tab of photographic material with an upper surface having an image affixed thereon.

11. The method of claim 9, including:

providing the outer portion with a second outer side and the inner portion forming a second cavity opening to the second outer side;

providing the second outer side with a second lip overlying the second cavity; and securing a second flexible tab within the second cavity by the second lip.

12. The method of claim 11, including:

providing a second cavity with an inner surface to support the second flexible tab; and surrounding a second recessed section by and below the inner surface.

13. The method of claim 12, including a second RHD chip within the second recessed section.

14. The method of claim 11, including the step of constructing the second flexible tab of photographic material with an upper surface having an image affixed thereon.

* * * * *